US006345669B1

(12) United States Patent
Buyers et al.

(10) Patent No.: US 6,345,669 B1
(45) Date of Patent: Feb. 12, 2002

(54) RECIPROCATING RUNNING TOOL

(75) Inventors: Mark Buyers; Simon Benedict Fraser, both of Dyce (GB)

(73) Assignee: Omega Completion Technology Limited, Dyce (GB)

( * ) Notice: Subject to any disclaimer, the term of this patent is extended or adjusted under 35 U.S.C. 154(b) by 0 days.

(21) Appl. No.: 09/530,988

(22) PCT Filed: Nov. 9, 1998

(86) PCT No.: PCT/GB98/03315

§ 371 Date: Jul. 5, 2000

§ 102(e) Date: Jul. 5, 2000

(87) PCT Pub. No.: WO99/24691

PCT Pub. Date: May 20, 1999

(30) Foreign Application Priority Data

Nov. 7, 1997 (GB) ..... 9723460

(51) Int. Cl.[7] ..... E21B 23/00

(52) U.S. Cl. ..... 166/381; 166/65.1; 175/321

(58) Field of Search ..... 166/381, 65.1, 166/53, 66.7, 385, 98, 117.7; 175/232, 321, 325.3, 326

(56) References Cited

U.S. PATENT DOCUMENTS

| | | | | | |
|---|---|---|---|---|---|
| 3,554,284 | A | | 1/1971 | Nystrom | 166/250 |
| 4,071,086 | A | | 1/1978 | Bennett | 166/177 |
| 4,109,521 | A | | 8/1978 | Youmans | 73/151 |
| 4,113,236 | A | | 9/1978 | Neinast | 254/134 |
| 4,192,380 | A | | 3/1980 | Smith | 166/250 |
| 4,332,420 | A | * | 6/1982 | Coski | 299/31 |
| 4,676,310 | A | | 6/1987 | Scherbatskoy et al. | 166/65 |
| 5,697,459 | A | * | 12/1997 | Sher | 175/95 |
| 5,740,126 | A | * | 4/1998 | Chin et al. | 175/40 X |
| 6,026,911 | A | * | 2/2000 | Angle et al. | 175/24 |
| 6,273,189 | B1 | * | 8/2001 | Gissler et al. | 166/241.1 |

FOREIGN PATENT DOCUMENTS

| | | |
|---|---|---|
| WO | WO95/21987 | 8/1995 |

* cited by examiner

*Primary Examiner*—Frank S. Tsay
(74) *Attorney, Agent, or Firm*—Madson & Metcalf

(57) ABSTRACT

A running tool which is intended to be lowered down a tubular member via a wireline extending from the surface to a connection to the upper end of the tool by which the tool is suspended, said tool being capable of advancing itself along the wall of the tubular member when required (e.g. when the tubular member is inclined to the vertical as a "lateral"), by repeated application and release of tension force in the wireline.

14 Claims, 4 Drawing Sheets

RECIPROCATING RUNNING TOOL

BACKGROUND OF THE INVENTION

This invention relates to a running tool for use in a pipe, pipeline, wellbore or other tubular member (referred to hereinafter as a "tubular member of the type specified"), and which typically IS employed in the extraction of liquid or gaseous hydrocarbons, water, and also in geothermal applications.

In oil and gas wells, and in other boreholes, it becomes necessary from time to time to install, or change various devices in the well, and to perform investigative and other surveys. Most of these operations rely on the use of a "wireline", which may be one of two types, namely "slickline" or "electricline". These terms are well known to those of ordinary skill in the art, and need not be described in detail herein.

A variety of tools and devices may be attached to a wireline, and lowered to the bottom of the wellbore, aided by gravity. Electricline has a conductor and insulator so that "downhole" tool responses can be electrically controlled, and measured from the surface as they happen. Slickline employs a single strand of wire, which can only be manipulated up or down to influence the tool or instrument operation in the wellbore.

Many wells are deviated in order that they may be drilled from a central point, but still be able to drain a large area. Deviated wells can have an angle of deviation of 70° or more, but the greater the angle of deviation i.e. the greater the angle measured from the vertical and towards the horizontal, the greater will be the problem for wireline operations. Thus, the greater the deviation angle, the lesser will be the effect of gravity, and which can become overcome by the friction of the wire as it moves through the deviation angle, and the rolling resistance of the tools or other devices at the "downhole" end. The traditional remedy for this problem has been to increase the weight of the wireline, by adding heavy weight bars, and by reducing the rolling resistance of the tools and weight bars by adding wheels and centralisers.

Some wells have 90°, or near 90° deviation, with correspondingly horizontal or near horizontal sections, and often running for thousands of feet, and this being situated at the bottom of a vertical shaft. These long horizontal sections or "laterals" are formed so as to improve drainage, or to access distant pockets of hydrocarbons.

In use of electricline systems, devices exist to pull the wireline along highly deviated, or horizontal sections, and such devices are known in the art as "tractors". These tractors convert a high voltage electrical supply which is passed down the insulated core of an electric wireline through a motor in the tractor which drives a hydraulic pump which is used to power a number of hydraulic motors. The motors are linked to wheels which are arranged around the body of the tractor, and positively drive it along the deviated section of the wellbore.

Electric line tractors can have a variety of tools and devices attached, for the purposes as described above. Such tools etc are selectively positioned in the wellbore, by powering the tractor until the required locations are reached. For subsequent retrieval of a tool, this is achieved by simply pulling on the cable after powering down the tractor.

The inherent nature of an electric wireline is such that an amount of special equipment for pressure control is required. Because the wireline is braided, the mechanism required for the prevention of well pressure escape is bulky and maintenance is intensive. The wire required to carry the high voltages associated with electric line tractors is not a type which would normally be available on site already, and the presence of high voltages in the presence and proximity of hydrocarbons raises severe safety questions during the operation of the equipment. Therefore, specialist personnel are normally required to operate the tractor equipment, in addition to the normal electricline crew. Electricline operations therefore, in general, are expensive.

Slickline wireline units, on the other hand, are almost universally present at production sites, and have simpler and more manageable pressure control equipment. The crew size is smaller, and slickline operations are therefore relatively inexpensive.

The invention therefore seeks to provide a running tool which is mechanically simple and does not require the complexity of operation, and cost of electricline operation, but which can be used with electricline, slickline, or any other wire or tubular system which is capable of reciprocating movement

SUMMARY OF THE INVENTION

According to one aspect of the invention there is provided a running tool which is intended to be lowered down a tubular member of the type specified, via a wireline extending from the surface to a connection to the upper end of the tool by which the tool is suspended, said tool being capable of advancing itself along the wall of the tubular member when required (e.g. when the tubular member is inclined to the vertical as a "lateral"), by repeated application and release of tension force in the wireline, in which the tool comprises:

an assembly of a leading body portion and a trailing body portion, said portions being connected to each other so as to be linearly movable relative to each other in order to advance the tool along the tubular member;

a linearly displaceable actuator within the assembly and connectable to the wireline, said actuator being movable from a datum position in one direction relative to the assembly upon application of tension to the wireline;

means for converting relative movement of the actuator in said one direction to linear displacement of the leading body portion in an opposite direction;

respective wall-engaging means on each of the body portions which can be triggered alternately into gripping contact with the wall of the tubular member; and, an energy source capable of being active between the body portions:

in which the tool has a cycle of self-advancing movement which comprises:

(a) application of tension via the wireline to the actuator so as to move the actuator in said one direction relative to the assembly;

(b) causing movement of one of said wall-engaging means into gripping contact with the wall of the tubular member to fix the respective body portion;

(c) storage of energy within said energy source as a consequence of the relative movement of the actuator;

(d) release of tension in the wireline thereby causing movement of the other of the wall-engaging means into gripping contact with the wall of the tubular member to fix the respective body portion and to cause release of said one wall engaging means;

(e) release of energy from said energy source so as to move the actuator relative to the assembly in an opposite direction to the datum position; aid, (f) causing advancing movement of the leading body portion relative to the wall of the tubular member when its respective wall engaging means is released from gripping contact with the wall of the tubular member during the cycle of operation.

A reciprocating running tool according to one preferred embodiment of the invention therefore can move along a tubular member or wellbore, dragging a wire behind it, and carrying additional tools or instruments ahead of it. Motive force is provided by pulling on the wire from the surface, and the tool is run into the wellbore until such time that the frictional forces stop the tool from further descent. The tool has wall-engaging means in the form of dragblocks which allow movement in the downward direction only. Pulling on the wire at this time will anchor the lower part of the device to the wall of the tubular member (or wellbore), and will charge a spring and advances the main body (upper assembly) of the tool. On relaxing the wire, the upper assembly anchors itself to the wellbore, and the spring then discharges its spring force advancing the lower body downwardly, ready for the next cycle. As the wire is slackened off at this time, additional wire will be fed into the well, to compensate for the distance that the tool has moved. In this way, by repeatedly pulling and then slacking-off the wireline, the tool can be caused to advance along the wellbore by simple mechanical propulsion.

Tool retrieval may be affected by over-pulling on the wireline, in order to collapse the mechanism which locates the dragblocks (locking means). The mechanisms are normally located and biased by use of a spring of known force. When this force is overcome, the locating means is removed and the locking means may unlock. A similar mechanism is present in both the main body, and the upper portion of the tool. Once the locking means has become unlocked, it is retained in the unlocked position and the tool may be dragged out of the well.

However, it is within the scope of the invention to have an alternative sequence of operations, during a cycle of self-advancing movement, as provided by further preferred embodiments of the invention.

In these further preferred embodiments, the wall engaging means associated with the trailing body portion is movable into gripping contact with the wall of the tubular member upon relative movement of the actuator in said one direction so that said movement converting means is effective to move the leading body portion in an advancing direction simultaneously with storage of energy in the energy source, and in which the wall-engaging means associated with the leading body portion is moved into gripping contact with the wall of the tubular member and the wall-engaging means associated with the trailing body portion is released from gripping contact with the wall of the tubular member upon release of tension in the wireline, so that the energy stored in the energy source is effective to return the actuator to the datum position and to advance the trailing body portion towards the leading body portion.

According to a further aspect of the invention, there is provided a self-advancing tool for use in an underground passage and controllable from the surface by means connecting the tool to the surface, said tool being capable of advancing itself along the passage by repeated reciprocation of said means.

BRIEF DESCRIPTION OF THE DRAWINGS

Preferred embodiments of running tool according to the invention will now be described in detail, by way of example only, with reference to the accompanying drawings, in which.

DESCRIPTION OF THE PREFERRED EMBODIMENTS

Figure 1:
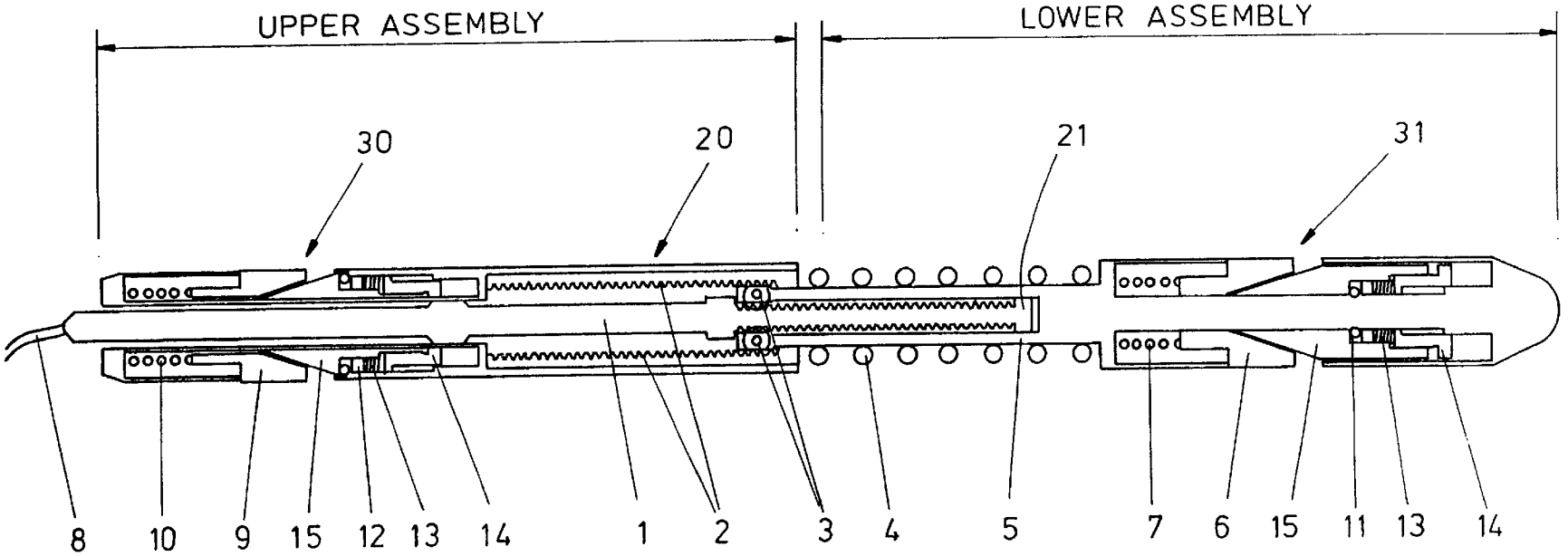
FIG. 1 is a side view, partly broken-open to show internal details, of a first embodiment of running tool according to the invention, for use in a tubular member of the type specified.

Referring first to FIG. 1 of the drawings, there is shown a running tool assembly according to a preferred embodiment of the invention, and which is designated generally by reference 20, and which it is assumed will be attached at the lower end of a wire via which it can be lowered down any type of tubular member of the type specified e.g. a wellbore. The wire can be an "electricline", a "slickline", or any other wireline of the type used in wellbore formation and in the extraction of liquid or gaseous hydrocarbons, water prospecting, or the geothermal industry.

The wire which lowers the tool 20, and which also can be used to initiate sequences of operation, to advance itself, along deviated sections is shown by reference 8. The tool 20 has an upper assembly, and a lower assembly, as shown, and which are capable of reciprocating movement, to advance the tool along deviated sections, in a manner described in more detail below. During operation, the upper assembly will comprise a trailing body portion 30, and the lower assembly will comprise a leading body portion 31.

The tool 20 has a central rod 1 forming an actuator for the tool and which is attached to the wire 8, and the upper end of the wire is connected to a winch at the surface. The rod 1 carries a toothed rack 21, and which is connected to an outer rack 2 by way of pinion gearwheels 3, and the intermeshing is such that upward movement of the rod 1 relative to the tool assembly 20 causes the outer racks 2 to move downwards against the action of a biasing (compression) spring 4. Therefore, a double rack and pinion arrangement is provided, to convert linear movement of the actuator rod in one direction into reverse movement of the trailing body portion 30. The gearwheels 3 are located on a tubular member 5 which must be retained, in order that the spring 4 can be compressed. This is achieved by provision of locking means, taking the form of lower dragblocks 6 which are biased outwards by spring 7. These dragblocks allow movement of the tool 20 downwards, but not upwards, and provide resistance to any pulling action exerted on the wire 8 from the surface. In this way, pulling on the wire with a force up to the known rated value of the spring 4, will charge the spring and "cock" the tool.

The lower dragblocks 6 are provided in the lower assembly, and generally similar upper dragblocks 9 are provided in the upper assembly. The upper dragblocks, when activated, prevent upward movement.

When the wire 8 is relaxed, by paying out cable from the surface, the spring 4 discharges its stored energy, by causing the upper dragblocks 9 to grip the wall of the tubular member, and then "stroke" out the lower assembly. The tool therefore advances itself along the tubular member by the same amount as the stroke. In this way, reciprocation of the wire, followed by feeding out extra wire, will cause the tool 20 to advance itself along the tubular member.

Recovery of the tool can be effected by pulling on the wire with a force which is greater than that which is required to fully compress the spring 4, but equal to that required to trip a detent assembly, having components 12, 13 and 14. This force would be set on the surface prior to placing the tool in the wellbore, by altering tension in spring 13 by operation of a screw cap 14. When the required force is applied, wedges 15 (one set in each of the upper and lower assemblies) act against the adjacent dragblocks 6 and 9 in the lower and upper assemblies respectively, and which collapse away from the dragblocks leaving them unsupported. The dragblocks will be forced out of gripping contact with the wall of the tubular member, and the entire tool 20 can then be dragged upwards and out of the wellbore in the normal manner.

The operating components of the tool have been described above with reference to FIG. 1, and FIGS. 2, 3 and 4 show the operation of the tool, during one cycle of self-advancing movement of the tool, initiated by operation of the wire.

The operating components of the tool assembly 20 shown in the drawings comprises a simple and entirely mechanically actuated device, set into operation by simple manipulation of the wire from which the device is suspended. However, in some circumstances, it may be desirable to employ power transmitting means other than purely mechanical linear reciprocating arrangement as shown. By way of example, the tool may incorporate a hydraulically operated arrangement. Further, the tool may incorporate a device having powered wheels which are hydraulically driven via a reciprocating hydraulic pump, and chain driven or similar wheels.

In addition to providing possibility of designing a hydraulically operated version of the tool, it should be noted again that the tool may be operated on the end of a slickline, electricline, or other means for lowering the tool down a tubular member, such as coiled tubing, or even a pipe.

The running tool disclosed herein is particularly suitable for use in the extraction of fluid hydrocarbons. However, it can also be employed in the water extraction industry, or other industries e.g. geothermal industry, in which boreholes are formed down to sources of energy.

Figure 2:
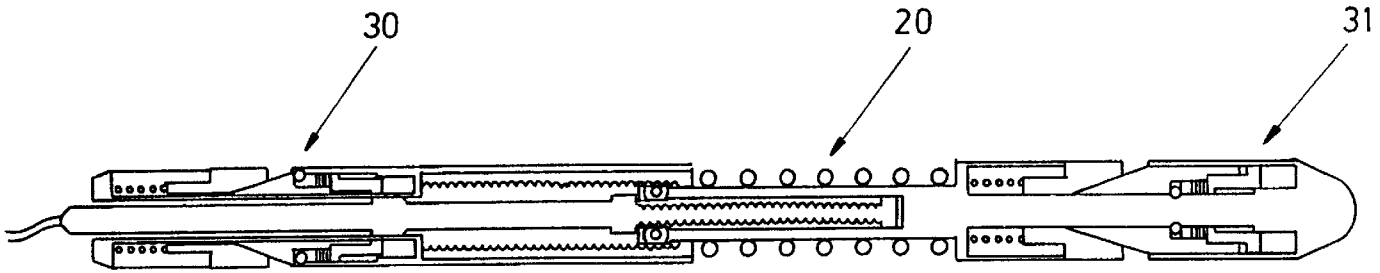
FIG. 2 shows the tool in an inoperative position, assuming a slack wire to which it is attached, and with the tool extended.
Figure 3:
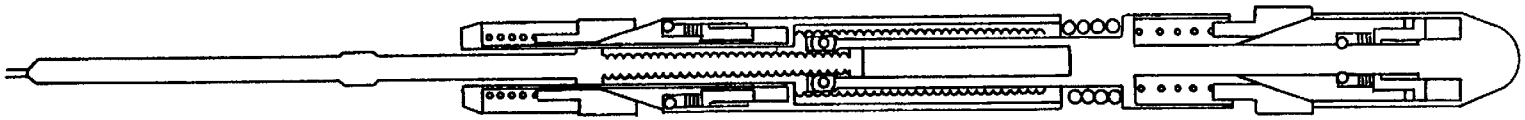
FIG. 3 is a side view, similar to FIG. 2, but showing the connecting wire tight, a biasing spring compressed, and the upper assembly of the tool advanced in a first stage of mechanically propelled advance of the tool.
Figure 4:
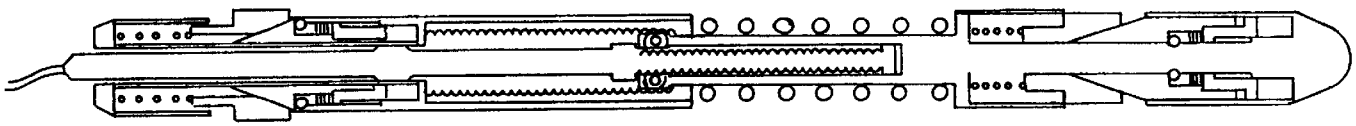
FIG. 4 is a side view showing the tool after it has advanced itself to an extended position of the lower assembly, at the completion of the operation, and ready for a further sequence of operation.

In the first embodiment shown in FIGS. 1 to 4, the self-advancing movement of the tool assembly 20 is achieved by the means illustrated in FIGS. 2, 3 and 4. In particular, upon application of tension to the wire 8, the actuator rod 1 moves upwardly relative to the tool assembly 20, and this causes the lower dragblock 6 associated with the (lower) leading body assembly 31 to engage the wall of the tubular member and thereby fix the leading body portion 31. The actuator rod 1 therefore can move to the left as shown in FIG. 3, relative to the tool assembly, and simultaneously compresses the spring 4 and thereby stores further energy in the spring. Upon release of tension in the wire 8, the lower dragblocks 6 become released from the wall of the tubular member, and the upper dragblock 9 moves outwardly into gripping contact with the wall of the tubular member in order to fix the trailing (upper) assembly 30. This then allows the energy stored in the spring 4 to move the lower assembly 31 to the right, as shown in FIG. 4, and simultaneously to return the actuator rod 1 to the datum position.

However, it should be understood that the invention contemplates other modes of self advancement of a tool assembly, again utilising components which are linearly moveable relative to each other during a cycle of operation, and using dragblocks which are moved, alternately, into and out of gripping engagement with the wall of the tubular member. However, in the further embodiments of tool to be described below, the sequence of operation of the dragblocks is different, as will become apparent from the following detailed descriptions.

Figure 5:
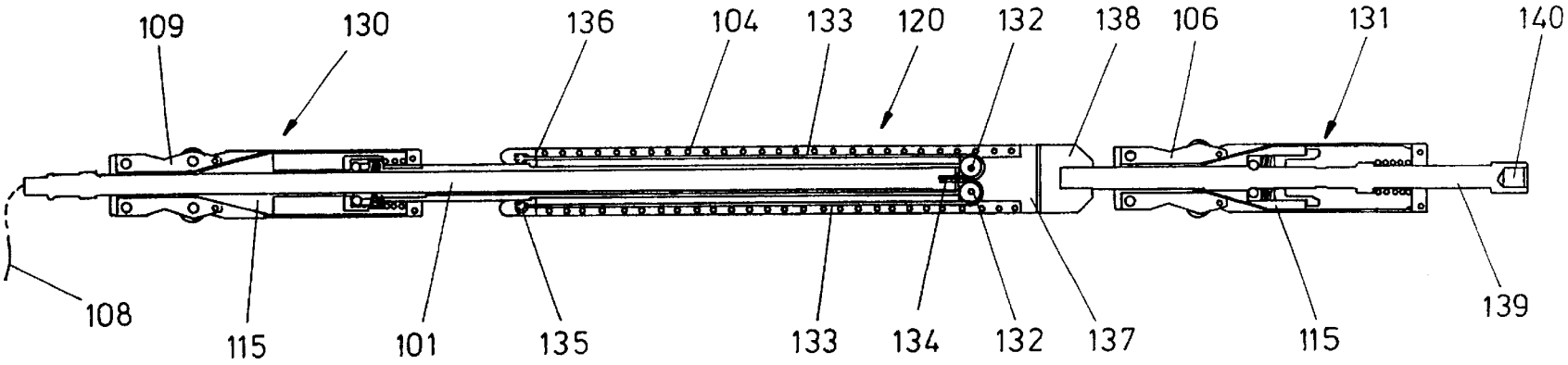
FIG. 5 is a side view of a second embodiment having an alternative mode of self-advancing movement along a tubular member.

Referring now to FIG. 5 of the drawings, there is shown a self-advancing tool assembly 120, having upper component assembly 130 and lower component assembly 131, and having associated wall-engaging means in the form of dragblocks 109 and 106 respectively. An actuator rod 101 is mounted internally of the tool assembly 120, and can be attached at its upper end (the left hand end in FIG. 5) to a wire which, in this arrangement, may comprise a slickline 108. An actuator rod element 139 is mounted internally of lower assembly 131, and at its lower end (the right hand end in FIG. 5) can be attached to additional downhole tools if required, via threaded socket 140.

In the embodiment of FIG. 5, a different mechanical arrangement is provided in order to transfer linear actuation movement from rod 101 to the components of the tool assembly 120. A housing 136 is slidably mounted externally on the actuator rod 101, and includes a coupling block 138 which is movable with the housing 136, and which transfers linear movement to actuator rod element 139 of the assembly 131 during a cycle of self-advancing movement of the tool 120. A reaction block 137 is mounted within the housing 136, and is movable with the actuator rod 101. Block 137 also mounts rotatably a set of two wheels 132, over which are taken respective cables (or chains) 133. Free ends 134 of the cables 133 are attached to the right hand end of rod 101, and linear displacement of rod 101 to the left will cause the chains 133 to pull the housing 136 to the right via anchor connections 135 of the chains 133 to the left hand end of housing 136.

During linear movement of the actuator rod 101 to the left, the housing 136, coupling block 138, actuator rod element 139 and lower assembly 131 move to the right, and at the same time a compression spring 104 is compressed between the left hand end of housing 136 and the reaction block 137, thereby to store-up energy for use in a further part of the cycle of operation.

A complete cycle of operation therefore comprises the following steps:

(a) apply a pulling force to the actuator rod 101 to the left, as shown in FIG. 5, via wire 108, and which causes dragblocks 109 to move outwardly into gripping contact with the wall of the tubular member under the action of cone blocks 115;

(b) further movement of actuator rod 101 to the left causes housing 136 and lower body assembly 131 to move to the right, while compression energy is stored in spring 104;

(c) release of tension in wire 108 then allows dragblocks 109 to be released from engagement with the wall of the tubular member, but the energy stored in spring 104 applies a force to the left to actuator rod element 139, causing lower blocks 115 to press lower dragblocks 106 outwardly into gripping contact with the wall of the tubular member, thereby to anchor the lower body assembly 131;

(d) with the lower assembly 131 fixed, the compression spring 104 then acts through housing 136 and chains 133 in order to pull the actuator rod 101 and the now released upper assembly 130 to the right, to complete one cycle of self-advancing movement of the tool assembly 120.

Figure 6:
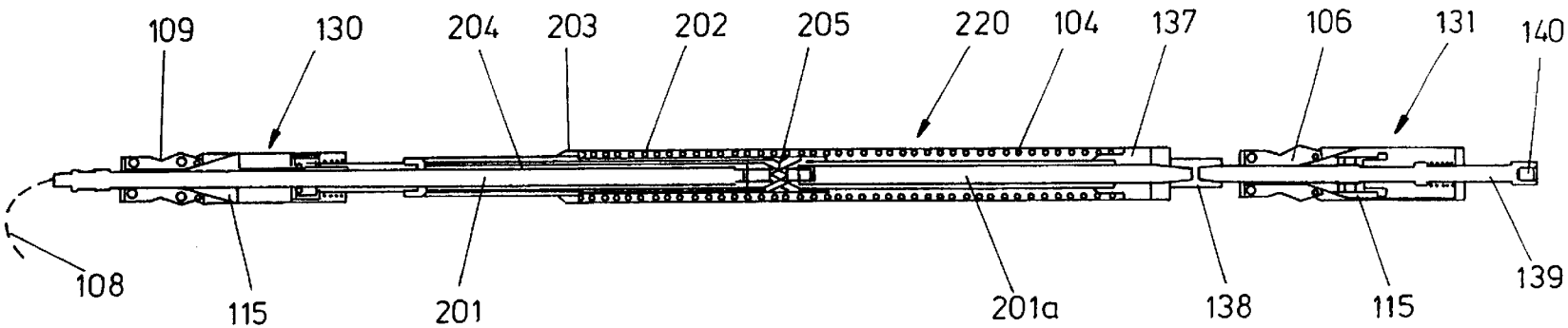
FIG. 6 is a side view of a third embodiment, operating in generally the same way as the embodiment of FIG. 5, but utilising fluid pressure means to transfer relative linear movement between components of the tool; and, FIG. 7 is a further view showing more detail of the tool of FIG. 6.
Figure 7:
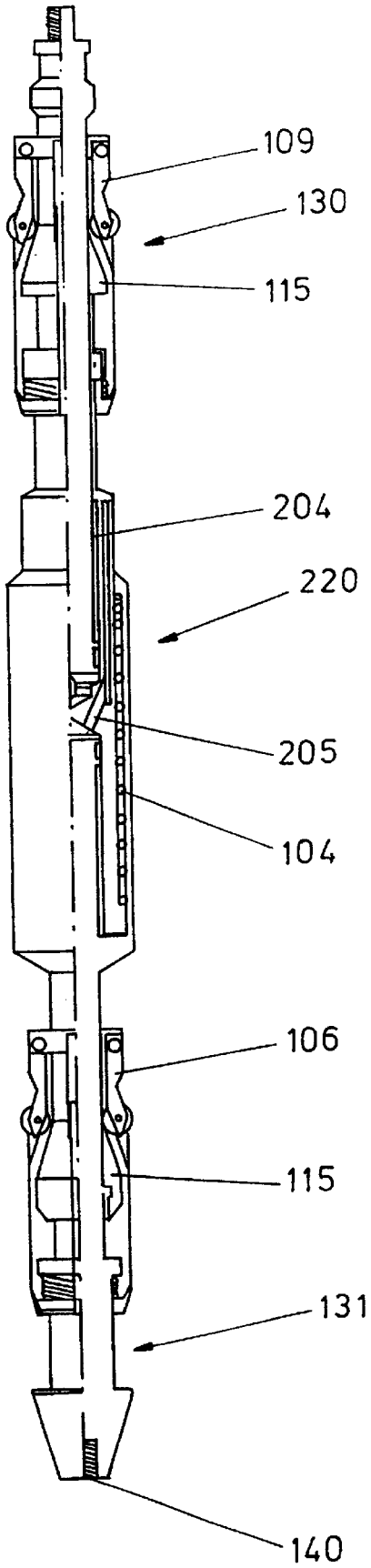

Referring now to FIGS. 6 and 7, there is shown a third embodiment of tool assembly 220, and which has a sequence of operations, in a cycle of self-advancing movement, which is generally similar to that described for the second embodiment shown in FIG. 5. Corresponding parts are therefore given the same reference numerals, and will not be described in detail again. However, in this third embodiment of the invention, fluid pressure means is employed in order to transfer linear movement relatively between the components of the tool, rather than purely mechanical means as in the embodiments described with reference to FIGS. 1 to 4, and FIG. 5.

An actuator rod 201 is mounted within housing 202, and these two components are capable of relative linear movement, with the actuator rod 201 effectively functioning as a hydraulic piston moving within a cylinder. A compression spring 104 is also housed within the housing 202, and surrounds the actuator rod 201, and reacts between left hand end 203 of housing 202 and reaction block 137 mounted internally at the right hand end of the housing 202. A further actuator rod component 201*a* is also slidably mounted within housing 202, and is moveable to the right under hydraulic pressure when the actuator rod 201 moves to the left following application of tension via wire 108 to the rod 201. Any suitable fluid pressure medium, preferably hydraulic fluid, is housed within a cylinder surrounding actuator rod 201, in annular space shown by reference 204, and transfer ports 205 allow fluid pressurised in annular space 204 by movement of actuator rod 201 to the left (acting like a piston within a cylinder) to escape and to apply pressure to a piston assembly at the left hand end of actuator rod 201*a,* which is then displaced linearly to the right. At the same time, housing 232 also is displaced linearly to the right, while applying compression energy to compression spring 104.

The lower body assembly 131 therefore is also displaced linearly in an advancing direction, and with the dragblocks 106 in the released position, similar to that described above for the embodiment of FIG. 5. The linear displacement of actuator rod 201 to the left, upon application of tension to wire 101, applies necessary transfer of linear motion to the other components, via fluid pressure transfer means, and by reason of the fact that the upper assembly 130 is fixed in position by outward movement of dragblock 109 into gripping engagement with the wall of the tubular member.

Release of tension in wire 108 then results in lower assembly 131 being fixed in position by outward movement of dragblock 106, and upper body assembly 130 then can move to the right (with the dragblock 109 now released) under the action of the energy stored in compression spring 104 and re-transfer of hydraulic fluid to the annular space 204.

What is claimed is:

1. A running tool which is intended to be lowered down a tubular member of the type specified, via a wireline extending from the surface to a connection to an upper end of the tool by which the tool is suspended, said tool being capable of advancing itself along the wall of the tubular member by repeated application and release of tension force in the wireline, in which the tool comprises:

an assembly of a leading body portion and a trailing body portion, said portions being connected to each other so as to be linearly moveable relative to each other in order to advance the tool along the tubular member;

a linearly displaceable actuator within the assembly and connectable to the wireline, said actuator being moveable from a datum position in one direction relative to the assembly upon application of tension to the wireline;

means for converting relative movement of the actuator in said one direction to linear displacement of the leading body portion in an opposite direction;

respective wall-engaging means on each of the body portions which can be triggered alternately into gripping contact with the wall of the tubular member; and, an energy source capable of being active between the body portions;

in which the tool has a cycle of self-advancing movement.

2. A tool according to claim 1, in which the wall-engaging means associated with the trailing body portion is arranged to be moved into gripping contact with the wall of the tubular member upon relative movement of the actuator in said one direction, so that said movement converting means is effective to move the leading body portion in an advancing direction simultaneously with storage of energy in said energy source, and in which the wall-engaging means associated with the leading body portion is then moveable into gripping contact with the wall of the tubular member and the wall-engaging means associated with the trailing body portion is disengaged from gripping contact with the wall of the tubular member upon release of tension in the wireline so that the energy stored in the energy source is effective to return the actuator to its datum position.

3. A tool according to claim 1, in which the wall-engaging means associated with the trailing body portion is moveable into gripping contact with the wall of the tubular member upon relative movement of the actuator in said one direction so that said movement converting means is effective to move the leading body portion in an advancing direction simultaneously with storage of energy in the energy source, and in which the wall-engaging means associated with the leading body portion is moved into gripping contact with the wall of the tubular member and the wall-engaging means associated with the trailing body portion is released from gripping contact with the wall of the tubular member upon release of tension in the wireline, so that the energy stored in the energy source is effective to return the actuator to the datum position and to advance the trailing body position towards the leading body portion.

4. A tool according to claim 1, in which the wall-engaging means comprise spring-loaded dragblocks.

5. A tool according to claim 1, in which the actuator comprises a rod slidable within the trailing body portion, and having a double rack and pinion interconnection with said trailing body portion.

6. A tool according to claim 1, in which the energy source comprises a compression spring.

7. A tool according to claim 1, in which the actuator comprises an actuator rod slidable within a housing and having a chain or cable and wheel type connection between the rod and the housing, to apply reverse linear motion between the rod and the housing.

8. A tool according to claim 1, in which the actuator comprises an actuator rod slidable within a cylinder relative to a housing, and having a chamber for receiving a pressure fluid; and transfer port to transfer fluid, upon relative movement in said one direction of said actuator rod, in order to apply reverse movement to a further actuator rod thereby to apply advancing movement to the leading body portion.

9. A method of advancing a running tool along an underground passage, using a tool according to claim 1, comprising the repeated steps of applying and releasing a tension force in the wireline.

10. A method according to claim 9, in which the underground passage is a deviated borehole connected to the surface by an upwardly extending borehole.

11. A method of according to claim 9, wherein the repeated steps of applying and releasing a tension force in the wireline comprise:

(a) applying tension via the wireline to the actuator so as to move the actuator in said one direction relative to the assembly;

(b) causing movement of one of said wall-engaging means into gripping contact with the wall of the tubular member to fix the respective body portion;

(c) storing energy within said energy source as a consequence of the relative movement of the actuator;

(d) releasing tension in the wireline thereby causing movement of the other of the wall-engaging means into gripping contact with the wall of the tubular member to fix the respective body portion and to cause release of said one wall engaging means;

(e) releasing of energy from said energy source so as to move the actuator relative to the assembly in an opposite direction to the datum position; and (f) causing advancing movement of the leading body portion relative to the wall of the tubular member when its respective wall engaging means is released from gripping contact with the wall of the tubular member during the cycle of operation.

12. A self-advancing tool for use in an underground passage and controllable from the surface by a wireline connecting the tool to the surface, said tool being capable of advancing itself along the passage by repeated reciprocation of said wireline, said tool comprising:

an assembly of a leading body portion and a trailing body portion, said portions being movable relative to each other to advance the tool along the underground passage;

a linearly displaceable actuator within the assembly which is connectable to the wireline, said actuator being movable from a datum position in one direction relative to the assembly upon application of tension to the wireline;

means for converting relative movement of the actuator in said one direction to linear displacement of the leading body portion in an opposite direction;

wall-engaging means on each of the body portions which are triggered alternately into gripping contact with the underground passage; and an energy source capable of storing and releasing energy as a consequence of the relative movement of the actuator.

13. A tool according to claim 12, in which the tool incorporates linearly reciprocatable components.

14. A tool according to claim 12, in which the tool is capable of conveying additional tool(s) coupled therewith.

* * * * *